US006346662B1

(12) United States Patent
Sielaff

(10) Patent No.: US 6,346,662 B1
(45) Date of Patent: Feb. 12, 2002

(54) ERGONOMIC PICK FOR STRINGED INSTRUMENT

(76) Inventor: Drayth S. Sielaff, 2629 S. Stone Hedge, Nampa, ID (US) 83686

( * ) Notice: Subject to any disclaimer, the term of this patent is extended or adjusted under 35 U.S.C. 154(b) by 0 days.

(21) Appl. No.: 09/663,018

(22) Filed: Sep. 15, 2000

Related U.S. Application Data

(60) Provisional application No. 60/154,172, filed on Sep. 15, 1999.

(51) Int. Cl.[7] ..... G10D 3/16
(52) U.S. Cl. ..... 84/322; 84/320
(58) Field of Search ..... 84/320, 322; D17/20, D17/99

(56) References Cited

U.S. PATENT DOCUMENTS

| | | | | |
|---|---|---|---|---|
| 2,016,438 A | | 10/1935 | Kealoha | 84/322 |
| 3,648,558 A | | 3/1972 | Chenette | 84/322 |
| 3,699,838 A | | 10/1972 | Montgomery | 84/322 |
| 3,735,663 A | | 5/1973 | Cowell, Sr. | 84/322 |
| 4,015,501 A | | 4/1977 | Schaller | 84/282 |
| 4,122,746 A | | 10/1978 | Freeman | 84/322 |
| 4,150,601 A | | 4/1979 | Henley, Jr. | 84/322 |
| 4,253,372 A | | 3/1981 | Fillipetti | 84/322 |
| 4,347,773 A | | 9/1982 | Zook | 84/322 |
| 4,625,615 A | * | 12/1986 | Lukehart | 84/322 |
| 4,867,032 A | | 9/1989 | Lukehart | 84/322 |
| 5,194,680 A | | 3/1993 | Reineck | 84/320 |
| D346,177 S | | 4/1994 | Reineck | D17/20 |
| 5,341,715 A | | 8/1994 | Hucek | 84/322 |
| 5,419,228 A | | 5/1995 | Garrett et al. | 84/322 |
| 5,610,349 A | | 3/1997 | Fogarty et al. | 84/322 |
| 5,648,622 A | | 7/1997 | Storey | 84/322 |
| 6,130,374 A | * | 10/2000 | Polidori | 84/322 |

* cited by examiner

*Primary Examiner*—Jeffrey Donels
*Assistant Examiner*—Kim Lockett
(74) *Attorney, Agent, or Firm*—Ken J. Pedersen; Barbara S. Pedersen

(57) ABSTRACT

Embodiments of an ergonomic stringed instrument pick are shown and described. The pick includes curved or depressed surfaces generally conforming to the shape of the thumb and index finger that grasp the pick. Preferably, the pick includes a depressed area on one side of the pick near the front tip of the pick for receiving the tip of the index finger, and includes a hump rearward of that depressed area for contacting the first joint area of the index finger. Preferably, the opposite surface of the pick includes a depressed area near the rear end of the pick for receiving the pad of the thumb, and includes a hump nearer the tip or the pick against which the thumb, in effect, pushes or braces. These features preferably take the form of a generally S-curved pick, with both the bottom surface and the top surface making two curves to form the desired shape, which reduces hand and wrist strain due to the increased comfort, and provides a more sure grip of the ergonomic shape. Additionally, pads, grips, or gel-filled packs may be added to one or both of the surfaces of the pick for increased comfort and better gripping.

20 Claims, 3 Drawing Sheets

ERGONOMIC PICK FOR STRINGED INSTRUMENT

This application claims priority of prior, co-pending provisional application No. 60/154,172, filed Sep. 15, 1999, entitled "Ergonomic Pick for Stringed Instrument".

BACKGROUND OF THE INVENTION

1. Field of the Invention

The present invention relates generally to a hand-held pick, which is also called a plectrum, that is used for playing a stringed instrument. More specifically, the invention relates to an ergonomic pick that increases comfort and sureness of grip for the user.

2. Related Art

Hand-held picks are conventionally used for plucking the strings of musical instruments, such as guitars, banjos, and lutes. Picks are typically thin, somewhat flexible pieces of metal, plastic, bone, or other material that are sized approximately the size of the pad of the thumb. The pick is held between the thumb and index finger for plucking strings in succession. Modern picks usually have one or more protruding/pointed areas in their outside edges, creating a picking "tip." The pick is usually positioned so that the picking tip protrudes generally beyond the tip of the index finger for easy and accurate contact with the individual strings. For example, a flat, thin, tear-shaped pick is popular, and the point of the "tear" is used as the picking tip.

Other shapes and designs have been developed for picks. For example, Lukehart (U.S. Pat. No. 4,625,615) discloses a tear-shaped pick with a V-shaped segment running from the middle of the pick out to one edge of the pick. The V-shaped segment results in the surface of the pick being raised in that area on one side of the pick and being depressed in that complementary area on the other side of the pick.

Hucek (U.S. Pat. No. 5,341,715) discloses a tear-shaped pick with a "stepped ledge" finger grip. The two steps of the Hucek device run from the center of the rounded edge of the pick forward diagonally across the pick in two directions, one step extending to the middle of each of the side edges.

Garrett (U.S. Pat. No. 5,419,228) discloses a pick with multiple playing surfaces. The Garrett pick is made of a triangular pick body and a rigid metal bar along the flat edge of the pick, opposite the picking tip. The metal bar serves as a grip for the thumb and the index finger and has two protruding ends that also may serve as picking tips.

Fogarty (U.S. Pat. No. 5,610,349) discloses an improved grip system for a pick, wherein the pick has a generally planar body with many small, raised cone-shaped bumps on both surfaces of the pick body for improving the user's grip. Also, Fogarty includes two walls extending out perpendicularly from pick body near one edge of the picking tip.

Storey (U.S. Pat. No. 5,648,622) discloses a triangular pick with a central area containing a plurality of spaced apertures that create a thin central area on the pick, for increasing the flexure of the central area. By adjusting the thumb and index finger locations while gripping the Storey pick, the player may alter the amount of pick flexibility for a note.

Various picks have been developed that include a strap system for attachment to a thumb or another finger. See, for example, Freeman (U.S. Pat. No. 4,122,746), Schaller (U.S. Pat. No. 4,015,501), or Lukehart (U.S. Pat. No. 4,867,032).

Still, there is a need for an improved pick design that is ergonomic, economic, and attractive. There is a need for a pick that reduces the stress that is felt by fingers and sometimes felt up the hand, wrist, and arm, which is created by the tension of gripping the small pick and applying force to the strings repeatedly and accurately. There is a need for a more securely held pick that does not drop, slide or twist in one's hand. The present invention addresses this need.

SUMMARY OF THE INVENTION

The present invention comprises a pick for a stringed musical instrument that has an ergonomic shape for increased comfort, less eventual muscle and tendon strain, and more secure positioning in the hand. The pick may include an improved grip system that also helps alleviate stress and discomfort, by making the user's grip more sure and, therefore, not necessarily so tight and tense. The improved ergonomics and the improved grip system of the invented pick comprises a more natural pick shape for the thumb and index finger, so that the thumb and finger more naturally grasp it, and the pick has less tendency to slide out of the hand or to twist out of the desired position. With this more natural grasp, and the reduction in tension and pressure necessary to securely hold the pick in the desired position and orientation without dropping, slipping or turning, there is less discomfort in the short term, and less strain and injury over the long term, for many users.

The invented pick comprises a generally thin pick body with a picking tip at one end and preferably an enlarged opposite end. The invented pick comprises a concave surface near the picking tip on the index finger side and a concave surface near the enlarged end on the thumb side. The preferred embodiment of this concave surface system is a pick that is curved in an Sshape when viewed from the side. Thus, the preferably smoothly-curved pick generally has two curves, one at about one-third of the way back from the picking tip and one about two-thirds of the way back from the picking tip. This profile allows the index finger to rest comfortably on the central and front bottom surface of the pick body, curving over the rear pick curve and extending into the front concave area. The thumb rests comfortably on the top surface of the pick body nearer the enlarged (rear) end, in the rear concave area. The inventor believes this places the finger and thumb in a natural position for applying an effective amount of pressure—with the pick naturally curving between the finger and thumb. This curved shape also provides some resistance to the pick twisting in the finger-thumb grasp. Overall, the invented pick shape is more comfortably and securely grasped, because it conforms generally to the natural curves of the pad and first joint of the index finger and of the pad of the thumb.

Optionally, the invented pick may comprise apertures, protrusions (as long as the protrusions are not angular or with corners, but only smooth and gradually curved) or a pad located generally centrally on the pick body, for further improving and/or cushioning the users grip. Specifically, the inventor envisions a dual-density system, wherein the pick body and picking tip is a fairly rigid and resilient plastic, and a pad of softer cushioning material or a pad filled with gel is affixed to the pick body to cover part of one or both of the top and bottom pick surfaces.

DESCRIPTION OF THE PREFFRRED EMBODIMENTS

Figure 1:
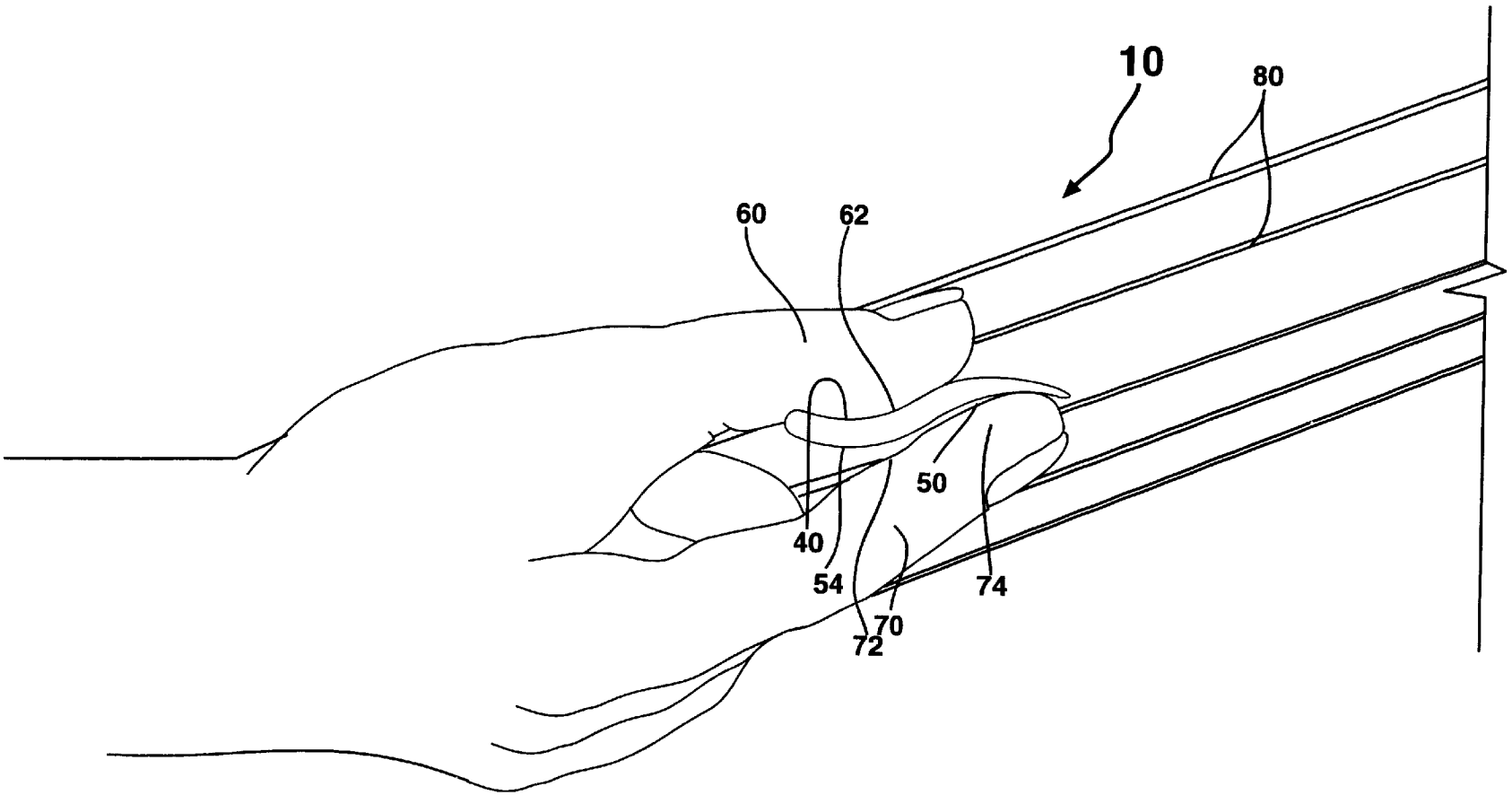
FIG. 1 is a side perspective view of one embodiment of the invented pick, in use on the strings of a musical instrument.

Referring to the Figures, there are shown several, but not the only, embodiments of the invented ergonomic pick for stringed instruments. In FIG. 1, the preferred pick 10 is shown in use with a stringed instrument. In FIGS. 2–8, there are shown various views of picks according to the invention.

Figure 2:
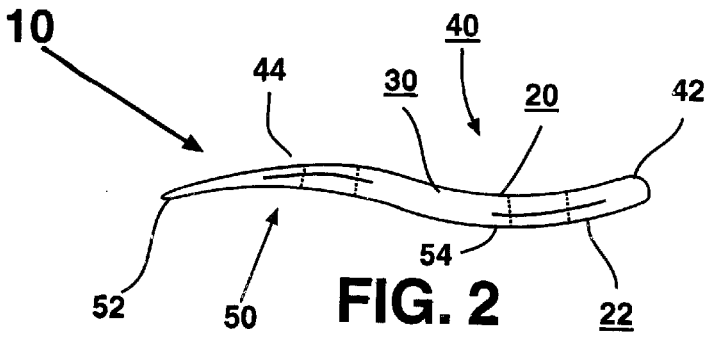
FIG. 2 is a side view of the pick of FIG. 1, with the picking tip to the left of the drawing, showing the curvature of the pick.
Figure 3:
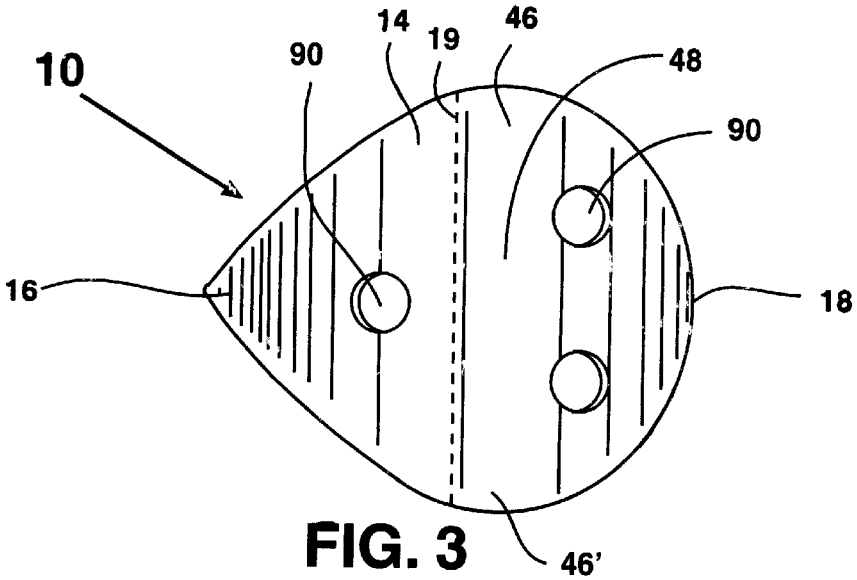
FIG. 3 is a top view of the pick of FIGS. 1 and 2.
Figure 4:
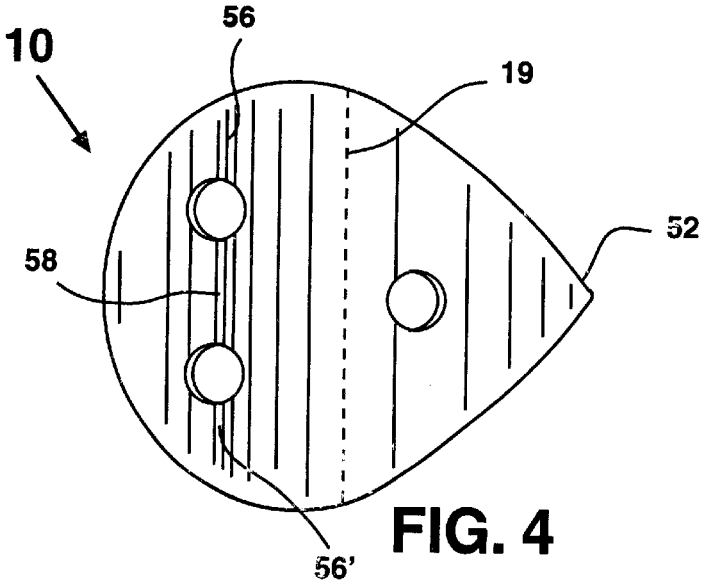
FIG. 4 is a bottom view of the pick of FIGS. 1–3.

The preferred pick 10 has generally a tear-shaped body 14 with a front picking tip 16 and a rear enlarged end 18, with the length of the pick being defined as extending between the tip 16 and the end 18 and a transverse line half way between the tip 16 and the end 18 being called the midline 19. The tear-shape of body 14 is shown to best advantage in FIGS. 4. The external shape of the body 14 is formed by a curved top surface 20 and a curved bottom surface 22, which are close together and generally parallel to each other, as best shown in FIG. 2. The top and bottom surfaces 20, 22 are surrounded by side surface 30 which is generally perpendicular to both surfaces 20, 22, and which represents the body 14 thickness at any position along the length of the pick. Preferably, but not necessarily, surfaces 20, 22 become nearer to each other gradually toward the front of the pick 10, that is, the thickness of the pick 10 tapers gradually from a thicker end 18 to a thin tip 16. This may be seen in the side views of the pick in FIG. 2, 5, and 7, wherein side surface 30 near tip 16 is narrow and pointed. The side surface 30 meets at picking tip 16 at about 90 degrees, or at other angles chosen for various styles of the invented pick 10 as preferred by the user.

Alternatively, but less preferably, the pick may not be tapered, that is it may be of about constant thickness along it's length, so that the tip has square corners between the top surface, the side wall and the bottom surface. Such an embodiment may be acceptable for some instruments and personal tastes. Also, the pick need not be necessarily tear-shaped, but it should have the two depressions or S-curve of the invention. For example, a triangular or rectangular shape is also envisioned.

The ergonomic design of the pick 10 comprises a concave depression 40 in the top surface 20, which is preferably due to the top surface 20 being curved in an S-shape, with the rear of the top surface curving upwards (toward the top of the page in FIG. 2), and the tip of the top surface curving downward). This depression 40, therefore, preferably is a trough between a raised rear end 42 and hump 44 that is nearer the tip 16, that is, hump 44 is about ⅓ third of the body length back from the tip. Preferably, the depression 40 is at about a 9/16" radius. Preferably, the sides 46, 46' of the depression are not raised relative to the center 48 of the depression, that is the depression is may be called a "trough" shape rather than a "bowl". Alternatively, however, embodiments of the invented pick may include slightly raised sides for further improving the user's grip on the pick, so that the depression 40 takes the form of a bowl to receive the thumb. The preferred depression 40, however, with its trough shape, may be described as the top surface 20 curving only longitudinally, and not curving transversely to any significant extent.

The ergonomic design of the pick 10 also comprises a concave depression 50 in the bottom surface 22, which is preferably due to the bottom surface 22 being curved in an S-shape. This depression 50, therefore, preferably is a trough between a raised tip end 52 and hump 54 that is nearer the rear of the body, that is, hump 54 is about ⅔ of the length back from the tip 16. Preferably, the depression 50 is at about a 1 ⅛" radius. Preferably, the sides 56, 56' of the depression are not raised relative to the center 58 of the depression 50, but some embodiments of the invented pick may include slightly raised sides 56, to form a bowl shape for receiving the index finger. The preferred trough-shaped depression 50 may be described as the bottom surface 22 curving only longitudinally, and not curving transversely to any significant extent.

As shown to best advantage in FIG. 1, the ergonomic pick 10 rests naturally and comfortably between the thumb 60 and the index finger 70 while the user plucks the strings 80. The thumb pad 62 rests in and frictionally contacts depression 40, while the first joint 72 of finger 70 rests over hump 54 and the tip 74 of the finger extends to frictionally contact depression 50. Thus, the thumb tends to be slightly back from the tip of the finger 70, which is a natural position for many players. The S-curved body 14 of the pick 10, therefore, curves naturally between the thumb and finger. The S-curved body 14 provides two depressions 40, 50 for the pads of the distal regions of the thumb and the index finger, and provides two humps 44, 54 that also conform to the general shape of the thumb and finger. The humps 44, 54, as well as the protruding ("raised") rear end 42 and tip end 52 (shown in FIG. 2), offer resistance to twisting, pulling, or pushing of the pick 10 out of proper position/orientation by the forces typically put on the pick during use. This makes gripping of the invented, curved pick 10 easier and more sure, because the pick is less likely to slide longitudinally either forward or rearward relative to the thumb and index finger.

As may be seen in FIGS. 2–6, several other grip-enhancing features may be added to the pick 10, 10'. For example, the pick of FIGS. 2–4 includes apertures 90 drilled or otherwise formed through the body 14 of the pick. Preferably three apertures 90 are arranged in a triangular pattern, with one being nearer the tip 16 and two being nearer the enlarged end 18. These apertures 90 are preferably round and about 1 millimeter in diameter, which provides a circular edge in the top surface around each of the apertures against which the thumb skin may grip and also a circular edge in the bottom surface around each of the apertures against which the finger skin may grip. In other words, the thumb and/or finger skin may push slightly into the apertures during use of the pick, which creates a more sure and slide-resistant grip of the pick.

Figure 5:
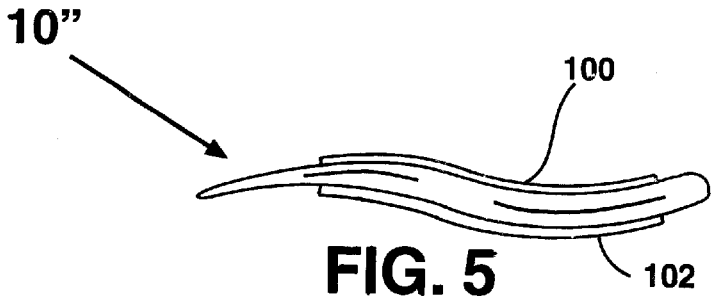
FIG. 5 is a side view of an alternative embodiment of the invented pick, including a cushioning/gripping pad on both the top surface and bottom surface of the pick.
Figure 6:
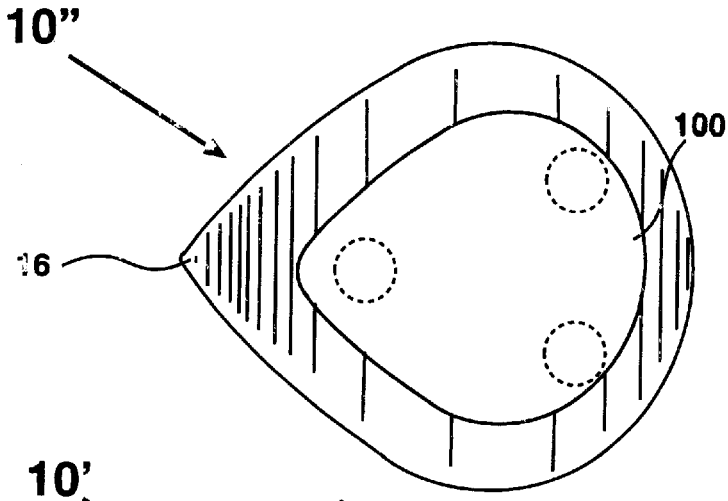
FIG. 6 is a top view of the pick of FIG. 5.

Preferably, the invented pick is supplied with at least one dual-density surface for improved comfort and gripping, that is, the pick body is preferably a relatively rigid plastic and a less rigid, more softer and pliable material is attached or formed in one or more of the pick surfaces. For example, cushioning/gripping material may be inserted through apertures 90. As shown in FIG. 5, a pad 100 may be placed on the top surface 20 of the pick, with fastening extensions 102 passing through the apertures 90 to secure the pad 100 to the pick. Preferably, the pad 100 and fastening extensions 102 are made of a rubber or other cushioning material that will give comfort to the thumb and finger and will provide a non-slippery grip for the user. Also, a gel-filled pad may be fastened to the pick. Or, smaller rivet-style cushions/grippers may be snapped through the apertures to provide a plurality of smaller pads on each of the gripping surfaces (top surface 20 and bottom surface 22), which smaller pads each have a smaller diameter than the single large pad 100. Dipping or other coating of the rear portion, for example, the rear half of the pick, with a soft, friction-enhancing surface may be beneficial. Alternatively, other methods of affixing a pad or grip are envisioned, for example, co-molding a softer plastic material onto the top and/or bottom surfaces during molding of the pick body. Or, using adhesives to attach a soft pad, pads, or grips.

Figure 7:
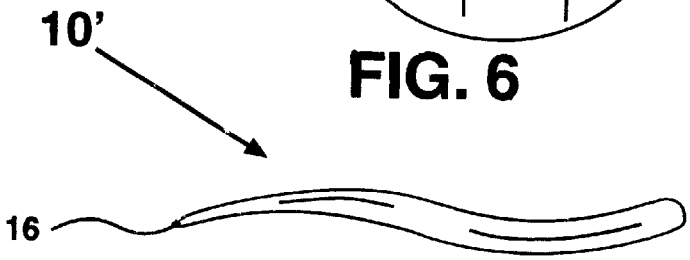
FIG. 7 is a side view of another embodiment of the invented pick, without apertures through the pick body and without pads.
Figure 8:
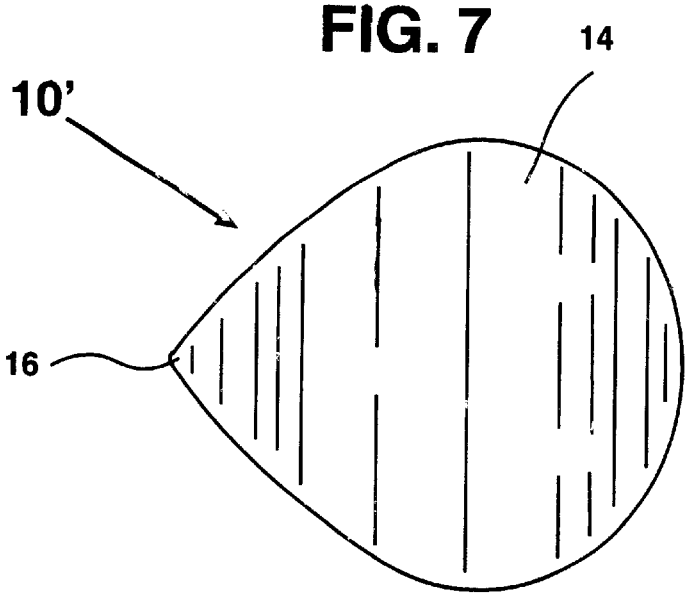
FIG. 8 is a top view of the pick of FIG. 7.

As illustrated in FIGS. 7 and 8, the invented pick may also be a simple, curved pick without apertures through the body and without any added additional padding or gripping material. The pick body may be made of high density polyethylene (HDPE) or nylon, for example, or other appropriate plastics which may be chosen by one skilled in the art of plastic molding. The top surface of the bottom surface may be molded or otherwise formed or worked to be slightly rough near the centers, for example, to have small grooves or ridges, for enhanced gripping, but this is not necessary, and smooth top and bottom surface are also expected to be effective due to the enhanced gripping produced by the curvature of the pick. In embodiments including cushion or grip pads, various materials may be used, for example, co-molded high density polyethylene (HDPE) or nylon plastic may be used to create, in effect, an inset of softer plastic with a top surface generally level with the surrounding pick body surface.

Preferably, the invented pick does not have straps or other means for encircling the thumb or finger or means for attaching to the thumb or finger. In it's preferred embodiment, it is simply a pick body shaped according to the above description plus a friction-enhancing gripping material on one or more surfaces for improving frictional contact between the pick and the user's skin. Any friction-enhancing gripping material or means preferably does not include any ledge on the top surface or bottom surface, that is, no angular areas or corners protruding up from the top surface or the bottom sureface that could be uncomfortable to the finger or thumb. Also, any apertures through the pick should be small enough so as not to let the skin become uncomfortable due to being wedged or "stuck" in the aperture over a length of time. In other words, while the top surface and bottom surface preferably are gripped securely by the thumb and finger, they are still generally smooth except for optionally a soft rubber or other pliant material.

Although this invention has been described above with reference to particular means, materials and embodiments, it is to be understood that the invention is not limited to these disclosed particulars, but extends instead to all equivalents within the broad scope of the following claims.

I claim:

1. An ergonomic pick for a stringed instrument, the pick comprising a generally planar member and having a top surface, and a bottom surface generally parallel to the top surface, a front tip end with a width, a rear end with a width, two opposing sides, longitudinal direction between the tip end and the rear end, and a transverse midline half way between the tip end and the rear end extending between the sides, the top surface having a thumb depression near the rear end between the transverse midline and the rear end, the thumb depression adapted to receive an instrument player's thumb pad, the bottom surface having a finger depression near the tip end between the transverse midline and the front tip end, the finger depression adapted for receiving the instrument player's index finger tip, and the bottom surface further having a raised area between the midline and the rear end adapted to support the player's index finger first joint.

2. A pick as in claim 1 that curves in an S-shape to form the thumb depression and the finger depression, wherein said thumb depression and said finger depression extend substantially all the way transversely across said planar member.

3. A pick as in claim 1 wherein the thumb depression is a trough that is concavely curved in a longitudinal direction and that is without any transverse curvature.

4. A pick as in claim 1 wherein the finger depression is a trough that is concavely curved in a longitudinal direction and that is without any transverse curvature.

5. An ergonomic pick for a stringed instrument, the pick comprising:

a generally planar member and having a top surface, and a bottom surface generally parallel to the top surface, a front tip end with a width, a rear end with a width, two opposing sides, longitudinal direction between the tip end and the rear end, and a transverse midline half way between the tip end and the rear end extending between the sides;

the top surface having a thumb depression near the rear end adapted to receive an instrument player's thumb pad;

the bottom surface having a finger depression near the tip end adapted for receiving the instrument player's index finger tip;

wherein the thumb depression is a trough that is concavely curved in a longitudinal direction and that is without any transverse curvature, wherein the thumb depression has a radius of curvature of about 9/16 inch.

6. An ergonomic pick for a stringed instrument, the pick comprising:

a generally planar member and having a top surface, and a bottom surface generally parallel to the top surface, a front tip end with a width, a rear end with a width, two opposing sides, longitudinal direction between the tip end and the rear end, and a transverse midline half way between the tip end and the rear end extending between the sides;

the top surface having a thumb depression near the rear end adapted to receive an instrument player's thumb pad;

the bottom surface having a finger depression near the tip end adapted for receiving the instrument player's index finger tip;

wherein the finger depression is a trough that is concavely curved in a longitudinal direction and that is without any transverse curvature, wherein the finger depression has a radius of curvature of about 1 1/8 inch.

7. An ergonomic pick for a stringed instrument, the pick comprising:

a generally planar member and having a top surface, and a bottom surface generally parallel to the top surface, a front tip end with a width, a rear end with a width, two opposing sides, longitudinal direction between the tip end and the rear end, and a transverse midline half way between the tip end and the rear end extending between the sides;

the top surface having a thumb depression near the rear end adapted to receive an instrument player's thumb pad;

the bottom surface having a finger depression near the tip end adapted for receiving the instrument player's index finger tip;

the pick having a thickness between the top surface and the bottom surface, wherein the thickness is smaller near the tip end than near the rear end.

8. The pick as in claim 1 comprising no straps extending from the pick to encircle the thumb or finger.

9. The pick as in claim 1 comprising no ledges on the top surface and no ledges on the bottom surface.

10. An ergonomic pick for a stringed instrument, the pick comprising:

a generally planar member and having a top surface, and a bottom surface generally parallel to the top surface, a front tip end with a width, a rear end with a width, two opposing sides, longitudinal direction between the tip end and the rear end, and a transverse midline half way between the tip end and the rear end extending between the sides;

the top surface having a thumb depression near the rear end adapted to receive an instrument player's thumb pad;

the bottom surface having a finger depression near the tip end adapted for receiving the instrument player's index finger tip;

the pick further comprising apertures through the pick from top surface to bottom surface for enhancing grip of the thumb and finger on the pick.

11. The pick of claim 10 comprising three apertures in a triangular arrangement.

12. The pick of claim 1 further comprising a resilient pad located generally centrally on the pick top surface for further improving and/or cushioning the user's grip.

13. The pick of claim 1 further comprising a resilient pad located generally centrally on the pick bottom surface for further improving and/or cushioning the user's grip.

14. The pick of claim 1 wherein the pick is a dual-density system, comprising a pick body and tip end of rigid plastic, and a pad of cushioning material on the top surface.

15. The pick of claim 1 wherein the pick is a dual-density system, comprising a pick body and tip end of rigid plastic, and a pad of cushioning material on the bottom surface.

16. An ergonomic pick for a stringed instrument, the pick having a top surface, and a bottom surface generally parallel to the top surface, a front tip end with a width, a rear end with a width, two opposing sides, a length between the tip end and the rear end, and a transverse midline half way between the tip end and the rear end extending between the sides;

wherein the pick curves substantially along its entire length to form an S-shape extending substantially along its entire length, the S-shape forming a thumb depression in the top surface near the rear end adapted to receive an instrument player's thumb pad, and forming a finger depression in the bottom surface near the tip adapted for receiving the instrument player's index finger tip.

17. A pick as in claim 16 wherein said thumb depression and said finger depression are each a trough that is concavely curved in a longitudinal direction and that is without any transverse curvature.

18. The pick as in claim 16 further comprising apertures through the pick from top surface to bottom surface for enhancing grip of the thumb and finger on the pick.

19. The pick of claim 16 further comprising a resilient pad for further improving and/or cushioning the user's grip.

20. The pick of claim 16 wherein the pick is a dual-density system, comprising a pick body and tip end of rigid plastic, and a pad of cushioning material for improving and/or cushioning the user's grip.

* * * * *